US006640998B1

(12) United States Patent
Kern

(10) Patent No.: US 6,640,998 B1
(45) Date of Patent: Nov. 4, 2003

(54) CAULKING GUN

(75) Inventor: Thomas D. Kern, Bradner, OH (US)

(73) Assignee: Albion Engineering Company, Philadelphia, PA (US)

( * ) Notice: Subject to any disclaimer, the term of this patent is extended or adjusted under 35 U.S.C. 154(b) by 0 days.

(21) Appl. No.: 10/088,660

(22) PCT Filed: May 19, 2000

(86) PCT No.: PCT/US00/13814

§ 371 (c)(1),
(2), (4) Date: Aug. 9, 2002

(87) PCT Pub. No.: WO00/71463

PCT Pub. Date: Nov. 30, 2000

Related U.S. Application Data

(60) Provisional application No. 60/135,718, filed on May 25, 1999.

(51) Int. Cl.[7] ..... B67D 5/00

(52) U.S. Cl. ..... 222/87; 222/88; 222/391

(58) Field of Search ..... 222/87, 88, 391

(56) References Cited

U.S. PATENT DOCUMENTS

| | | | | |
|---|---|---|---|---|
| 4,493,436 A | | 1/1985 | Brokaw | |
| 4,681,524 A | * | 7/1987 | Ikeda et al. | 425/376.1 |
| 5,101,562 A | | 4/1992 | Horvath et al. | |
| 5,273,190 A | * | 12/1993 | Lund | 222/83 |
| 5,564,598 A | | 10/1996 | Camm et al. | |
| 5,615,807 A | * | 4/1997 | Peng | 222/391 |
| 5,626,263 A | * | 5/1997 | Lii | 222/192 |

* cited by examiner

*Primary Examiner*—Joseph A. Kaufman
(74) *Attorney, Agent, or Firm*—Caesar, Rivise, Bernstein, Cohen & Pokotilow, Ltd.

(57) ABSTRACT

A caulking gun having a hand-held trigger operating clamp with a blade mounted on the clamp whereby the clamp and the bar cooperate to cause a cartridge containing caulk to move axially against a fixed plunger mounted on the clamp and the blade servers the cartridge containing caulk to permit the plunger to be advanced the length of the cartridge containing caulk.

16 Claims, 2 Drawing Sheets

CAULKING GUN

This is a continuation of provisional patent application Ser. No. 60/135,718, filed May 25, 1999.

FIELD OF THE INVENTION

The present invention relates to caulking guns and more particularly to a caulking gun wherein a cartridge containing caulk is moved axially against a fixed plunger causing the caulk to be emitted in metered quantities from an associated nozzle.

BACKGROUND OF THE INVENTION

Caulk is commonly used for home repair and the like. The caulk is typically applied to militate against liquid and air from penetrating the interface between building components. A caulking gun is used to hold a cartridge containing caulk and cause the caulk to be dispensed from a nozzle on the cartridge.

In prior art caulking guns, the plunger for forcing the caulk from the cartridge containing caulk is caused to move in an axial direction toward the cartridge nozzle while the cartridge remains fixed. As the cartridge containing caulk is emptied, the weight of the remaining caulk is concentrated at one end of the cartridge. A weight imbalance is created and can cause fatigue in the user resulting in short duty cycles.

An object of the invention is to produce a caulking gun which is easy to use.

Another object of the invention is to produce a caulking gun which is economical and simple in structure.

Still another object of the invention is to produce a caulking gun which is surprisingly well balanced thus enabling the user longer duty cycles without undue fatigue.

Another object of the invention is to produce a caulking gun where the user is able to insert and remove the cartridge containing caulk with ease.

SUMMARY OF THE INVENTION

The above, as well as other objects of the invention, may be readily achieved by a caulking gun having: an elongate bar; a clamp mechanism for moving the bar in a first axial direction; a plunger mounted on the clamp; a bracket secured to the bar for receiving a cartridge containing caulk and permitting a caulk emitting nozzle thereof to extend therethrough; and at least one blade mounted on the clamp for axially severing the cartridge containing caulk as the bar, the bracket, and the cartridge are caused to move by the clamp relative to the plunger.

BRIEF DESCRIPTION OF THE DRAWINGS

The above, as well as other objects, features, and advantages of the present invention will be understood from the detailed description of the preferred embodiments of the present invention with reference to the accompanying drawings, in which.

DETAILED DESCRIPTION OF THE ILLUSTRATED EMBODIMENT

Figure 1:
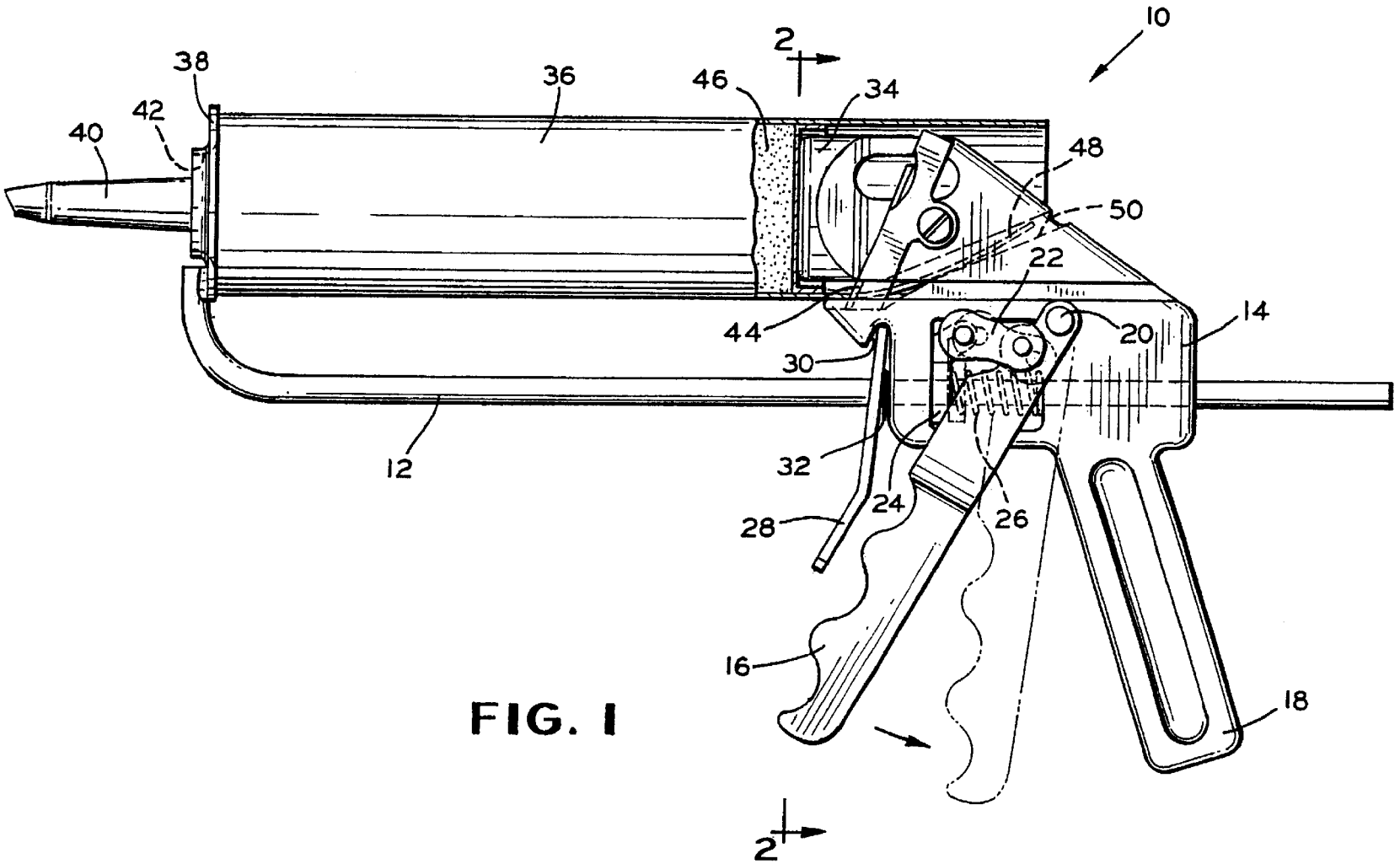
FIG. 1 is a side elevational view of a caulking gun assembly with portions cut-away incorporating the features of the invention illustrating the gun in use with a cartridge containing caulk.
Figure 2:
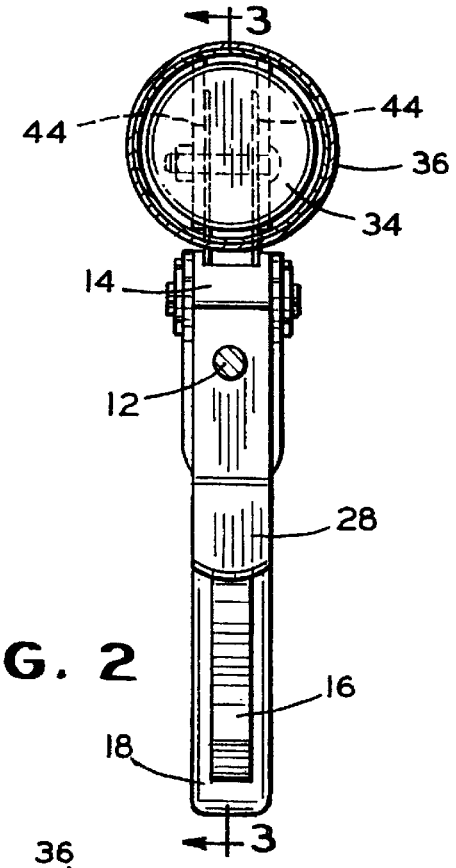
FIG. 2 is a sectional view of the caulking gun assembly taken along line 2—2 of FIG. 1.

Referring now to the drawings, and particularly FIG. 1, there is shown generally at 10 a caulking gun incorporating the features of the invention. The caulking gun 10 includes an elongate bar 12. The bar 12 is adapted to be disposed in sliding relation within a hand held clamp mechanism 14.

The clamp 14 includes an operating trigger 16 and an associated handle grip 18. The trigger 16 is pivotally mounted to the clamp 14 by a pin 20. A linkage 22 is disposed between the grip 18 and a collar 24 to translate the pivoting motion of the trigger 16 into linear motion of the bar 12. The collar 24 includes an aperture formed therein. Hence, the trigger 16 of the clamp 14 is effective to move the bar 12 in a first axial direction.

The bar 12 is inserted through an axial spring 26 which has one end seated against the clamp 14. The other end of the spring 26 urges the collar 24 against a flat surface of the clamp 14 which is substantially perpendicular to the longitudinal axis of the bar 12.

The clamp 14 further includes a locking lever 28 for militating against retrograde movement of the bar 12 in a direction opposite to the first axial direction caused by the clamp 14. The locking lever 28 is pivotally disposed in a groove 30 formed in the clamp 14. The bar 12 is inserted through an aperture formed in the locking lever 28 and an axial spring 32. One end of the spring 32 is seated against the clamp 14 and the other end of the spring 32 urges the locking lever 28 outwardly from the clamp 14. The locking lever 28 thereby militates against a reverse movement of the bar 12 with respect to the clamp 14.

The clamp 14 includes a plunger 34. The plunger 34 is adapted to be received within the base of a cartridge containing caulk 36. The plunger 34 can be formed as part of the clamp 14 or as a part separate from the clamp 14.

A bracket 38 secured to the bar 12 is adapted to receive the caulk emitting nozzle 40 of the cartridge 36. The caulk emitting nozzle 40 extends through a suitable aperture 42 formed in the bracket 38. The bracket 38 is in axial alignment with the plunger 34.

Two blades 44 are mounted on the clamp 14 adjacent the plunger 34. The blades 44 are employed to axially sever the wall of the cartridge 36 as the bar 12 and the bracket 38 are caused to move axially by the clamp 14. As the cartridge 36 is thus moved, the plunger 34, being fixed relative to the axial movement thereof, is effective to penetrate the interior of the cartridge 36 and force the caulk 46 in the cartridge 36 outwardly through the nozzle 40. In order to allow the plunger 34 to penetrate the interior of the cartridge 36, the blades 44 are effective to remove a strip 48 of the side wall of the cartridge 36. The strip 48 of the side wall of the cartridge 36 is caused to enter a passageway 50 to prevent interference with operation of the caulking gun 10.

In operation, the trigger 16 is pulled toward the handle grip 18. The trigger 16 is thereby caused to pivot about the pin 20. The linkage 22 is caused to move with the trigger 16 and causes the collar 24 to grip the bar 12. The bar 12 is caused to move in the direction of the movement of the trigger 16 and consequently the bracket 38 is caused to move toward the plunger 34 to force the caulk 46 outwardly through the nozzle 40. The spring 26 urges the collar 24 to return to its original position and hence the trigger 16 to return to its original position for a repeat of the action detailed above.

As the bar 12 is moved axially by operation of the operating trigger 16, the locking lever 28 will readily permit the axial movement in the first direction and militates against a reverse movement. At the completion of a caulking operation, or when it is desired to remove the cartridge 36 from the caulking gun 10, the locking lever 28 is grasped and pulled toward the handle grip 18, freeing the bar 12 to move axially. The spring 32 urges the locking lever 28 to return to its original position, thereby continuing to militate against reverse movement of the bar 12.

As the cartridge 36 empties, the weight of the unused caulk 46 remains adjacent the clamp 14. Balance around the clamp 14 is therefore maintained as the cartridge 36 empties which results in less fatigue and extended duty cycles for the user.

From the foregoing description, one ordinarily skilled in the art can easily ascertain the essential characteristics of this invention and, without departing from the spirit and scope thereof, can make various changes and modifications to the invention to adapt it to various usages and conditions in accordance with the scope of the appended claims.

What is claimed is:

1. A caulking gun for a cartridge including an exit nozzle and containing caulk comprising:

a an elongate bar;

a clamp mechanism for moving said bar in a first axial direction;

a plunger mounted on said clamp mechanism;

a bracket secured to said bar for receiving a cartridge containing caulk and permitting the exit nozzle thereof to extend therethrough; and at least one blade mounted on said clamp mechanism for axially severing the cartridge containing caulk as said bar is caused to move in the first axial direction.

2. The caulking gun according to claim 1, wherein said clamp mechanism is a trigger operated type clamp.

3. The caulking gun according to claim 1, including a locking lever for militating against retrograde movement of said bar in a direction opposite to the first axial direction.

4. The caulking gun according to claim 3, wherein said lever has an aperture, said bar extending through the aperture of said lever.

5. The caulking gun according to claim 4, wherein said lever is pivotally mounted on said clamp mechanism.

6. The caulking gun according to claim 1, wherein said bracket is in axial alignment with said plunger.

7. The caulking gun according to claim 1, wherein said clamp mechanism includes a passageway formed therein to permit a strip removed from the cartridge containing caulk to pass therethrough as said bar is caused to move in the first axial direction.

8. The caulking gun according to claim 1, wherein said clamp mechanism and said plunger are formed as an integral part.

9. A caulking gun for a cartridge including a caulk emitting nozzle and containing caulk comprising:

an elongate bar;

a hand-held trigger operated clamp for moving said bar in a first axial direction;

a plunger mounted on said clamp;

a bracket secured to said bar in alignment with said plunger for receiving a cartridge containing caulk and permitting the caulk emitting nozzle thereof to extend therethrough; and at least one blade mounted on said clamp for axially severing the cartridge containing caulk as said bar is caused to move in said first axial direction.

10. The caulking gun according to claim 9, including a locking lever for militating against retrograde movement of said bar in a direction opposite to the first axial direction.

11. The caulking gun according to claim 10, wherein said lever has an aperture, said bar extending through the aperture of said lever.

12. The caulking gun according to claim 11, wherein said lever is pivotally mounted on said clamp.

13. The caulking gun according to claim 9, wherein said bracket is in axial alignment with said plunger.

14. The caulking gun according to claim 9, wherein said clamp includes a passageway formed therein to permit a strip removed from the cartridge containing caulk to pass therethrough as said bar is caused to move in the first axial direction.

15. The caulking gun according to claim 9, wherein said clamp and said plunger are formed as an integral part.

16. A caulking gun for a cartridge including an outlet for caulk and containing caulk comprising:

an elongate bar;

a hand-held trigger operated clamp for moving said bar in a first axial direction;

plunger mounted on said clamp;

a bracket secured to said bar in alignment with said plunger for receiving a cartridge containing caulk and permitting the outlet thereof to extend therethrough; and at least one blade mounted on said clamp for axially severing the cartridge containing caulk as said bar is caused to move in said first axial direction.

* * * * *

UNITED STATES PATENT AND TRADEMARK OFFICE

CERTIFICATE OF CORRECTION

PATENT NO. : 6,640,998 B1
DATED : November 4, 2003
INVENTOR(S) : Thomas D. Kern

Figure 3:
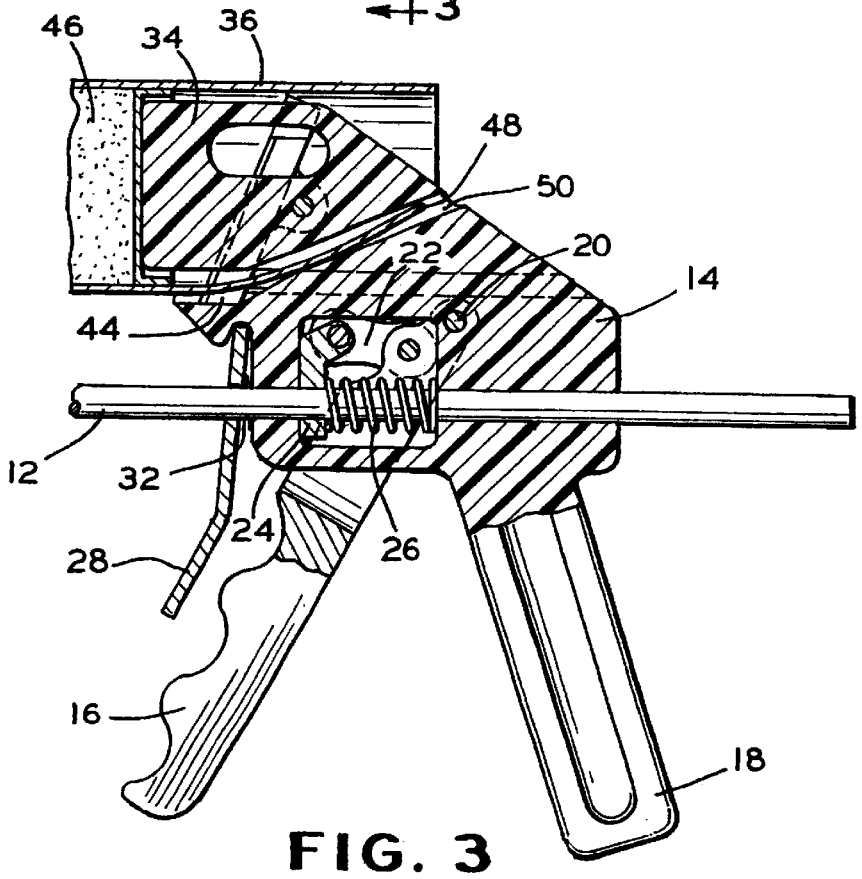
FIG. 3 a fragmentary sectional view of the caulking gun assembly generally taken along line 3—3 of FIG. 2.

It is certified that error appears in the above-identified patent and that said Letters Patent is hereby corrected as shown below:

Column 1,
Line 66, "Fig. 3 a" should read -- Fig. 3 is a --.

Column 3,
Line 23, the first word of the line, "a", should be deleted.

Column 4,
Line 41, "plunger" should read -- a plunger --.

Signed and Sealed this

Thirtieth Day of March, 2004

JON W. DUDAS
*Acting Director of the United States Patent and Trademark Office*